US006675446B2

(12) United States Patent
Buettell

(10) Patent No.: US 6,675,446 B2
(45) Date of Patent: Jan. 13, 2004

(54) ATTACHABLE NECK LANYARD SLIDER

(75) Inventor: Bruce J. Buettell, Fullerton, CA (US)

(73) Assignee: J.A.M. Plastics, Inc., Anaheim, CA (US)

( * ) Notice: Subject to any disclaimer, the term of this patent is extended or adjusted under 35 U.S.C. 154(b) by 0 days.

(21) Appl. No.: 09/940,383

(22) Filed: Aug. 27, 2001

(65) Prior Publication Data

US 2003/0037416 A1 Feb. 27, 2003

(51) Int. Cl.[7] ..... A44B 17/00
(52) U.S. Cl. ..... 24/122.6; 24/712.2; 24/115 H
(58) Field of Search ..... 24/712.7, 712.9, 24/712.1, 712.2, 115 H, 129 R, 3.4, 66.9, 49.1–66.13, 712–715.7, 90.1–114.12

(56) References Cited

U.S. PATENT DOCUMENTS 2,538,508 A * 1/1951 Palma ..... 24/129 R
2,877,527 A * 3/1959 Bond ..... 24/115 H
3,074,135 A * 1/1963 Brodowski ..... 24/115 G
3,138,839 A * 6/1964 Mathes ..... 24/712.5
3,500,508 A * 3/1970 Bennett ..... 24/1
3,813,737 A * 6/1974 Larsen ..... 24/129 R
4,049,357 A * 9/1977 Hamisch, Jr. ..... 16/444
4,258,456 A * 3/1981 Thurston et al. ..... 24/543
4,344,240 A * 8/1982 Schiller ..... 24/108
4,912,814 A * 4/1990 McKenzie ..... 24/115 H
5,008,981 A * 4/1991 Smithson ..... 24/115 G
5,029,371 A * 7/1991 Rosenblood et al. ..... 24/115 G
5,315,741 A * 5/1994 Dubberke ..... 24/115 G
5,337,458 A * 8/1994 Fukutomi et al. ..... 24/115 G
5,345,656 A * 9/1994 Merritt ..... 24/115 H
5,365,641 A * 11/1994 Watanabe et al. ..... 24/115 G
5,493,731 A * 2/1996 Amnott ..... 2/148
5,504,977 A * 4/1996 Weppner et al. ..... 16/442
5,669,119 A 9/1997 Seron
5,671,508 A * 9/1997 Murai ..... 24/115 K
5,842,494 A * 12/1998 Wu ..... 135/33.41
6,003,214 A * 12/1999 Lee ..... 24/712.1
6,339,865 B1 * 1/2002 Takahashi et al. ..... 24/115 G

* cited by examiner

*Primary Examiner*—Robert J. Sandy
*Assistant Examiner*—Dinesh N Melwani
(74) *Attorney, Agent, or Firm*—Knobbe, Martens, Olson & Bear LLP

(57) ABSTRACT

A two-piece slider for a lanyard is adapted to be assembled for sliding on a lanyard cord. The slider has features to restrain the pieces from relative rotation. Such features include a recess/protrusion combination having non-circular shape, an off-center pin/hole combination, or the slots in which the lanyard is placed adapted to restrict rotation. The slider has a flat surface with a rim around it for receiving a customer selected logo or design.

6 Claims, 6 Drawing Sheets

ATTACHABLE NECK LANYARD SLIDER

FIELD OF THE INVENTION

The present invention is directed to lanyard sliders, and more particularly, to an improved system for connecting a slider to a lanyard cord.

BACKGROUND OF THE INVENTION

In sports and other activities, lanyards comprising a cord, are often worn around one's neck in order to retain a small object such as a key, whistle, or identification badge, and yet leaving the hands free. Lanyards have been used in such an application for some time, and are well known. Typically, the ends of the cord are secured together with an easily releasable connection such as a ferrule. Typically a ring, hook, clasp, clip or end fitting hardware is provided for attaching an object to the cord.

Lanyards often include sliders which are used to reduce the size of the loop surrounding the wearer's neck, as well as for aesthetic purposes. Typical sliders are a solid piece of material with one or more holes through which the lanyard may be placed. The lanyard cord is typically threaded through holes of the slider during manufacture of the lanyard due to the fact lanyards are often either fabricated into a loop, or the hardware at each end of the lanyard is too large to pass through the holes in the slider. Lanyard cords are available in many different colors and materials. Lanyards are additionally provided with many different end fittings. Sixty-four combinations are offered in a current catalog and, of course, more could be made. Some customers want a slider and some do not. Carrying assembled lanyards with sliders would double the number of units. It is not practical for a manufacturer to maintain an inventory of all desired assembled lanyards with or without sliders and with cords of varying style, color and end fittings. Special orders could be utilized to reduce inventory needs, but that is also impractical from a cost and time standpoint. Thus, a need exists for an improved system for meeting customer needs.

SUMMARY OF THE INVENTION

In accordance with the invention, a two-piece lanyard slider is provided that can be assembled with a variety of cords and end fittings and with a customer-selected design or logo. One embodiment of a lanyard slider having preferred features and advantages includes a slider comprising a first portion adapted to mate with a second portion having at least one channel to receive a lanyard cord. The slider portions can be readily assembled on a customer selected lanyard cord and end fitting. According to one embodiment, the first portion may comprise a non-circular protrusion that fits within a mating recess in the second portion to restrain the portions from rotation relative to one another. This ensures that a logo or design on the slider is properly oriented. In any of the embodiments, the outer surface of one slider portion has a surface surrounded by a rim for receiving a design or logo.

Another embodiment of a slider for a lanyard comprises a first portion having a split post that fits within a hole in a second portion. Also provided is at least one slot to receive a lanyard cord. In a preferred embodiment, the split post portions include barbs on their tips, and the second portion has a shoulder to retain the barbs.

In one embodiment, the slider first portion has a non-circular protrusion formed on a cap having a disc shape from which the protrusion and a post extend. The protrusion and a recess on the second portion or base are adapted to interact to restrain the slider portions from rotation relative to one another.

According to another embodiment, a slider for a lanyard comprises a first portion having a pair of channels. A slider second portion has two channels that mate with the channels on the first portion to form complete passages for receiving a lanyard cord. The portions are adapted to snap together to capture the cord. The slider may further comprise means to restrict relative rotation between the two portions. The channels may have a substantially semi-circular shape, a substantially semi-elliptical shape, or a substantially rectangular shape. The channels may be either parallel or non-parallel.

With the described sliders, a quantity of slider caps and slider bases are inventoried, together with a quantity of lanyard cords with the various end fitting hardware. When a customer order is received for a lanyard cord of a particular color or type, with a particular end fitting, and with a slider, the cord is assembled into the channels in the slider base, and the cap is snapped onto the base to capture the cord. A desired logo or design can then be mounted on the slider, preferably on a rimmed surface on the cap.

This system is particularly advantageous when the lanyards without a slider are manufactured and assembled in countries with low labor costs. The slider with customized printing, if desired, can then be added in the customer's country which may have higher labor costs.

BRIEF DESCRIPTION OF THE DRAWINGS

Having thus summarized the general nature of the invention, certain preferred embodiments and modifications thereof will become apparent to those skilled in the art from the detailed description herein having reference to the figures that follow.

DETAILED DESCRIPTION OF THE PREFERRED EMBODIMENT

Figure 1:
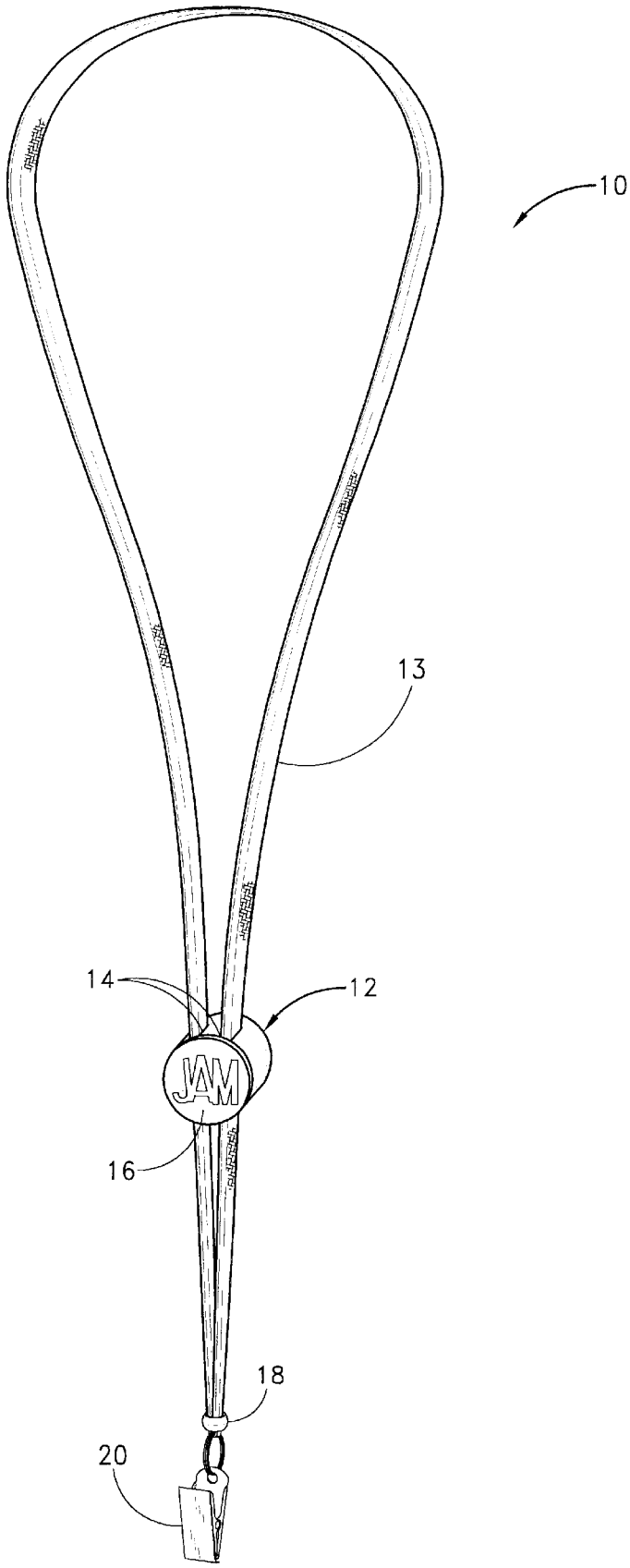
FIG. 1 is a perspective view of a lanyard with a slider disposed thereon.

FIG. 1 shows a lanyard 10 having a two-piece slider 12 slidably disposed on a lanyard cord 13 positioned slots 14 within the body of the slider 12. The slider 12 is preferably disposed on the cord 13 such that a flat surface 16 faces outwards as shown. The terms "top," "bottom," "front" and "back" as used herein in reference to various parts of the slider 12 will refer to the orientation shown in FIG. 1, as this is the orientation in which the slider will most commonly be worn. The front of the slider 12 preferably comprises a flat surface 16 which may be decorated with a logo, decal, or other design as requested by the customer from the manufacturer or seller. In a typical arrangement, a bead or ferrule 18 or other similar item is frictionally disposed on the lanyard cord below the slider 12 to frictionally retain the ring or other device 20 disposed at the bottom of the lanyard 10. The slider 12 is preferably made of a suitable molded plastic. The plastic used is preferably sufficiently rigid to allow small features to be substantially resilient when necessary. Metals or other materials may also be used without departing from the spirit of the present invention.

Figure 2:
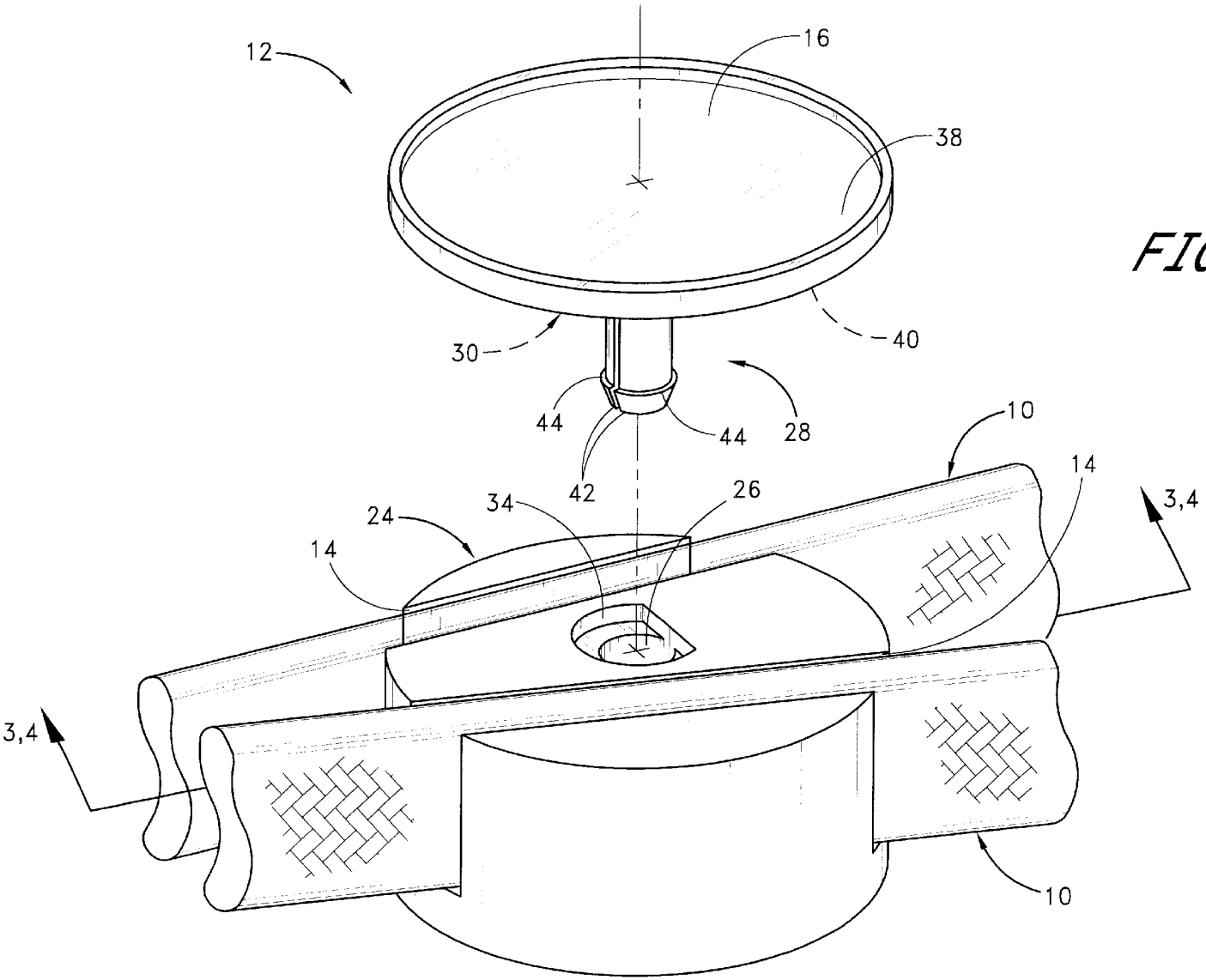
FIG. 2 is a perspective assembly view of a two-piece lanyard slider.

As shown in FIG. 2, the slider 12 is preferably substantially cylindrical in shape, however, other three-dimensional shapes may be employed. A slider 12 having preferred features and advantages comprises a male portion or cap 22 and a female portion base 24. Preferably, the cap and base are molded as completely separate elements. The cap 22 comprises features adapted for insertion through a hole 26 in the base 24. In this embodiment, a post 28 is designed to be inserted in to the hole 26, such that the cup 22 will "snap-fit" into the base 24 so as not to be readily removable. The caps 22 also preferably has an irregularly shaped protrusion 30 (seen in FIGS. 3-5) at the base of the post 28. The protrusion 30 is adapted to be received by a similarly shaped recess 34 in the base 24 such that the protrusion 30 and recess 34 act as a key in order to restrict relative rotation between the two parts 22, 24. Alternatively, as will be recognized by those skilled in the art, the protrusion may be on the base 24 with a corresponding recess on the cap 22 if so desired.

With continued reference to FIG. 2, the base 24 also preferably comprises slots 14 shaped and sized to receive a lanyard cord 13. The cap 22 is preferably sized and shaped such that the cord will be retained within the slots 14 of the base 24 once the slider 12 is assembled, as shown in FIG. 1. The preferred shape and features of the slots will be discussed below, but the slots may comprise any shape, size or number such that the slider operates as described herein.

Figure 3:
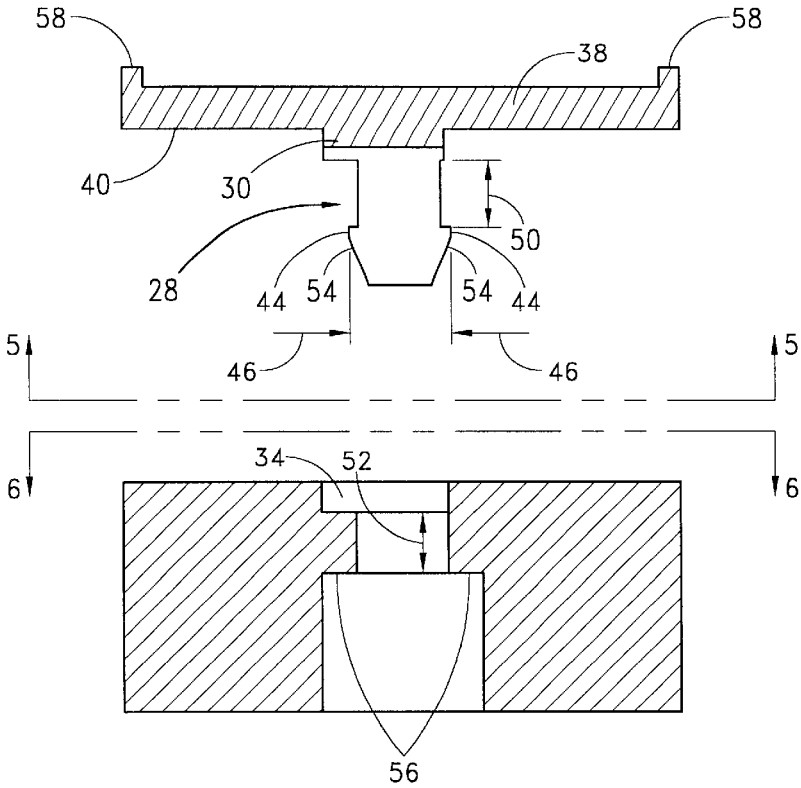
FIG. 3 is a section view of the slider of FIG. 2 shown disassembled.
Figure 4:
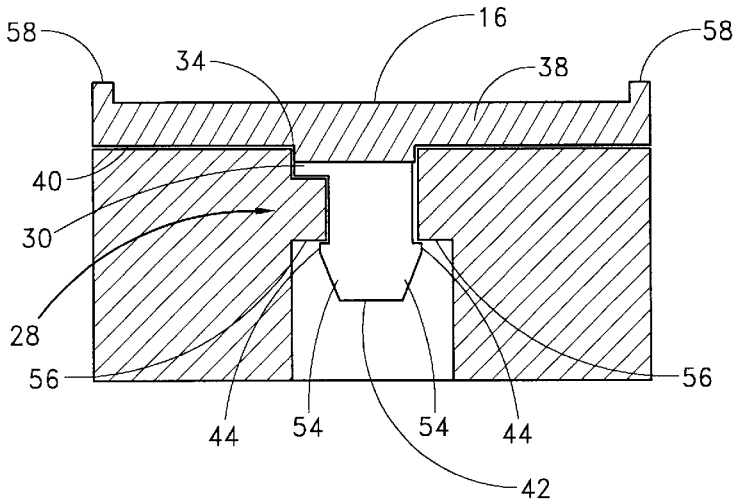
FIG. 4 is a section view of the slider of FIG. 2 shown assembled.

With reference now to FIGS. 2-4, the male portion 22 generally comprises a substantially flat disc section 38 having on its back side 40 the post 28 extending substantially away from the disc section 38. The post 28 is preferably divided into two split post portions 42 having barbs 44 at their tips. Alternatively, the post 28 may be split into three or more split post portions as desired. The split post portions 42 are preferably substantially resilient such that they will preferably flex towards one another in the direction of the arrows 46 when the post 28 is inserted into the hole 26. The split post portions 42 are preferably completely separated such that the gap 48 between them extends along their entire length so as to allow the maximum degree of deflection. Alternatively, the male portion may comprise a single solid post, and the female portion may comprise flexible members within the central hole adapted to receive and retain the post.

The barbs 44 at the distal end of the split post portions 42 are preferably sized and positioned such that the linear dimension indicated by reference number 50 of the split post portions 44 is substantially equal to the linear dimension indicated by reference number 52 on the female portion 24 such that the male and female portions may be assembled substantially as shown in FIG. 4. The barbs 44 also preferably comprise sloped sections 54 in order to facilitate insertion into the female portion 24. The hole 26 in the female portion 24 through which the post 28 is to be inserted preferably widens to form a shoulder 56 within the body of the female portion 24. The shoulder 56 will engage the barbs 44 once the post 28 is fully inserted through the hole 26, thereby retaining the male portion 22 within the female portion 24.

With continued reference to FIGS. 2-4, the male portion 22 preferably has a rim 58 surrounding the periphery of the front surface 16 of the disc portion 38. The front surface 16 of the male portion 22 is preferably the visible surface of the slider 12 once assembled on a lanyard cord, as shown in FIG. 1. Thus the rim 58 surrounding the visible face of the male portion 22 may frame a decal or sticker placed on the flat front surface 16.

Figure 5:
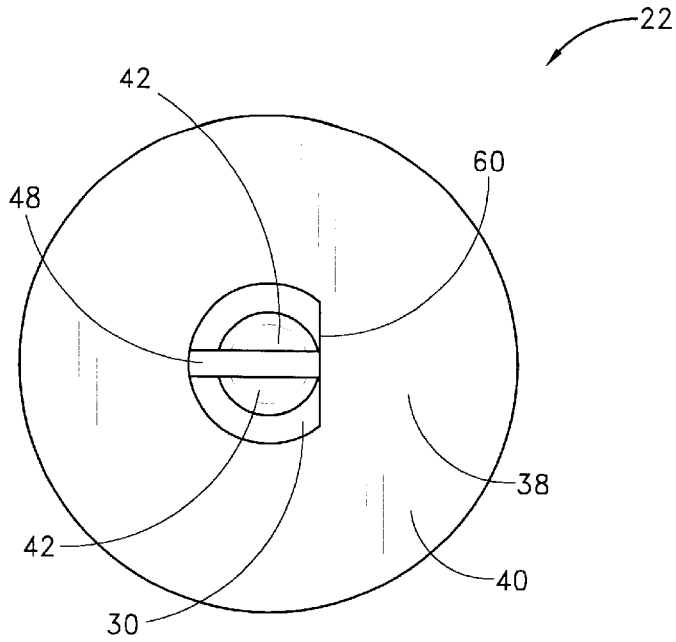
FIG. 5 is a plan view of the first piece of the slider of FIG. 3.
Figure 6:
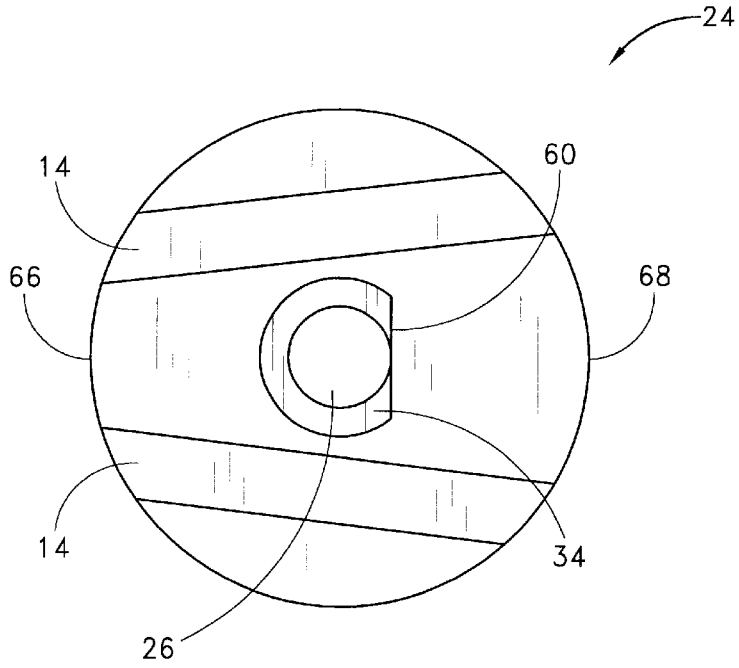
FIG. 6 is a plan view of the second piece of the slider of FIG. 3.

As shown in FIG. 5, the protrusion 30 on the male portion preferably comprises a substantially D-shaped (that is, round with a flat edge 60) raised protrusion 30 at the base of the post 28. The gap 48 between the two split post portions 42 may extend at least partially into the protrusion 30. As shown in FIG. 6, the female portion 24 preferably comprises a similarly shaped recessed feature 34 in which the D-shaped protrusion will sit when the slider 12 is assembled. The D-shaped protrusion 30 and the D-shaped recess 34 interact to prevent relative rotation which otherwise could result in loss of orientation of the male portion 22. The protrusion and recess may comprise essentially any non-circular shape such that the male and female portions are restricted in their relative rotations.

Figure 7:
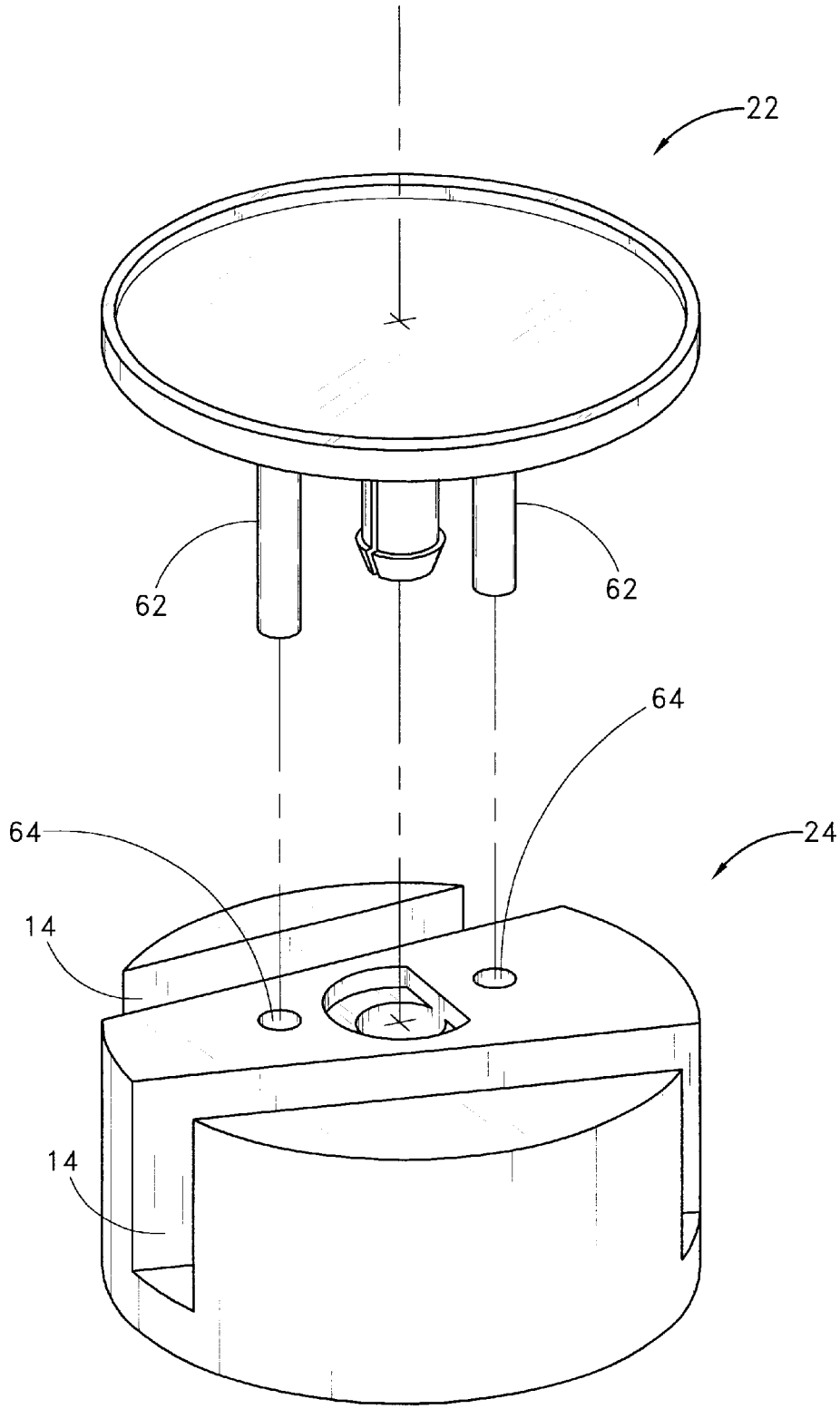
FIG. 7 is a perspective assembly view of an alternative embodiment of a two-piece lanyard slider.

In an alternative embodiment shown in FIG. 7, the protrusion on the male portion may include one or more pins 62, and the female portion 24 may have corresponding holes 64 into which the pins 62 may sit once the slider 12 is assembled. In this way relative rotation between the two parts may also be restricted.

The hole 26 through which the male portion may be inserted (see FIG. 2) is preferably located at the geometric center of the female portion 24 as viewed in FIG. 6. On either side of the recess 34 is the pair of slots 14 which provide a space in which a lanyard cord may be placed. The slots 14 have a substantially rectangular cross section, as best seen in FIGS. 2, 6 and 7. The rectangular slots are particularly suited for use with a flat-woven lanyard like that shown in FIG. 2. Alternatively, other slot cross sections may be desirable to correspond with the shape of the particular lanyard cord to be used. For instance, the slots could be substantially semi-circular or semi-elliptical to accommodate a round or elliptical lanyard cord. The slots 14 are preferably non-parallel as shown in FIG. 6 in order to conform to a natural position of the lanyard cord (see FIG. 1) with the cord 10 being close together at the bottom 66 of the slider, and further apart at the top 68. The slots 14 may be more or less parallel than those shown as desired. Alternatively, one may desire only a single slot through which both lanyard segments may be placed.

In assembly of the slider 12, the lanyard cord 13 is placed within the slots 14 formed in the female portion 24. The post 28 of the male portion 22 is then inserted into the central hole 26 in the female portion 24 while aligning the D-shaped protrusion 30 with the D-shaped recess 34, until the barbs 44 of the post 28 are fully inserted through the hole 26. Once fully inserted, the split post portions 42 are returned to their separated position such that the barbs 44 engage the shoulder 56 (see FIG. 4) of the female portion 24, thereby retaining the male portion 22 within the female portion 24. Once fully assembled, the lanyard 10 will preferably slide freely through the slots 14, and the disc section 38 of the male portion will prevent the lanyard cord 10 from being removed from the slider 12.

Figure 8:
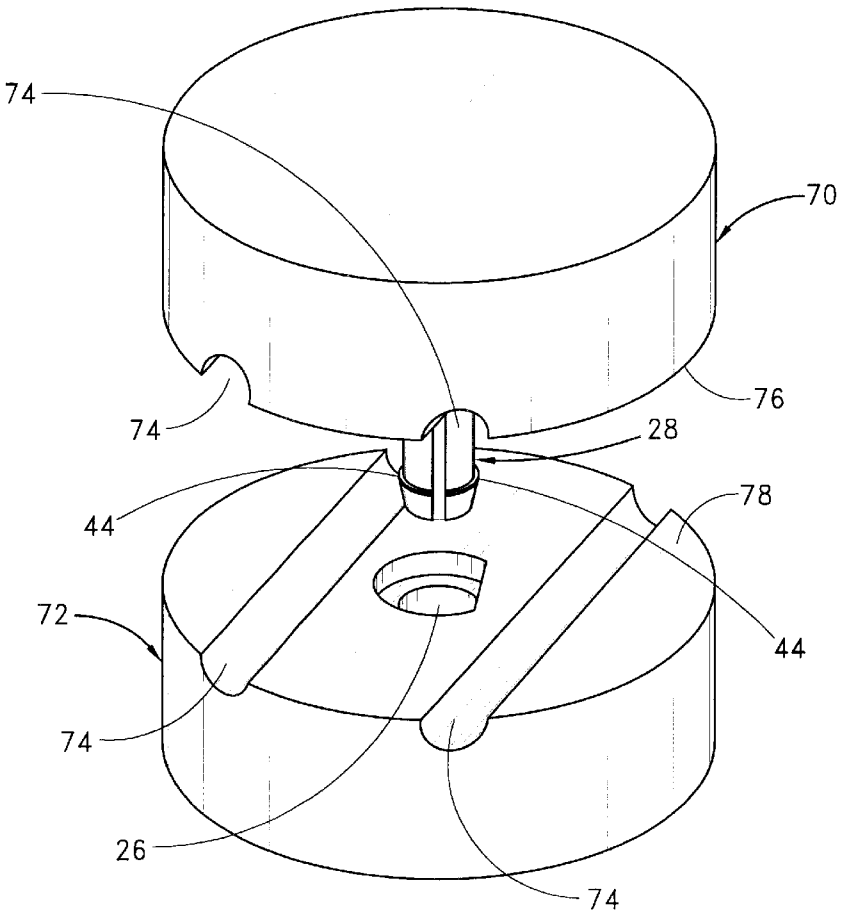
FIG. 8 is a perspective assembly view of an alternative embodiment of a two-piece lanyard slider.

In an alternative embodiment shown in FIG. 8, both the male and female portions 70, 72 may comprise substantially semi-circular slots 74 sized to receive a lanyard cord with a circular cross section. As with the above embodiments, the male portion 70 comprises a split post 28 with barbs 44 formed to be received within a central hole 26 having a shoulder (as discussed with reference to FIGS. 3 & 4) formed in the female portion 24. The slider of the present embodiment may comprise a protrusion/recess combination to restrain the male and female portions 70, 72 respectively from rotation relative to one another as discussed above. Alternatively, the embodiment of FIG. 8 may omit the protrusion and recess combination, thus relying on the lanyard cord within the slots 74 to restrain the male and female portions 70, 72 respectively from relative rotation. The split post is preferably sized such that the barbs 44 engage the shoulder when the flat surfaces 76, 78 respectively of the male and female portions 70, 72 respectively, are in contact. If desired, the slots 74 may be sized such that the lanyard cord is slightly compressed within the slots when the slider 12 is assembled.

Although this invention has been disclosed in the context of certain preferred embodiments and examples, it will be understood that the invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A slider for a lanyard comprising:

a first cylindrical portion having a central hole coaxial with the cylindrical base member and extending between first and second circular faces, said first face comprising a pair of spaced channels extending across the first face on either side of the central hole; and a second cylindrical portion having lower and upper circular faces, said lower face comprising a pair of spaced channels that mate with the channels on the first portion to form complete channels to receive portions of a lanyard cord, and said second portion having a centrally-located bifurcated post adapted to be inserted into the hole of the first portion to enable the portions to snap together to capture the cord in the channels while permitting the slider to slide on the cord, wherein the upper face is configured to display an image;

wherein the bifurcated Post of the second portion comprises barbs adapted to engage a shoulder within the second portion, and wherein the second portion comprises a non-circular protrusion at a base of the post, and the first face of the first portion comprises a non-circular recess adapted to receive the protrusion to restrain the first portion and second portion from rotation relative to one another, such that an orientation of the second portion is maintained relative to the second portion.

2. The slider of claim 1, wherein the non-circular protrusion and the non-circular recess are substantially in the shape of a 'D.'

3. The slider of claim 2, wherein the upper surface of the second portion comprises a substantially flat disc with an exterior surface adapted for displaying a design, with a raised rim around the surface.

4. A lanyard slider comprising:

a substantially cylindrical base portion having first and second circular faces and a central hole extending between the first and second faces and co-axial with the base member, and a pair of channels on either side of the hole and extending perpendicular to the axis of the central hole, each of said channels having a bottom wall, first and second side walls, first and second open ends, and an open top, said channels being straight and non-parallel;

a circular cap portion having a substantially flat upper surface surrounded by a raised rim and a substantially flat bottom surface and a bifurcated post extending from the bottom surface, the post comprising barbs and being adapted to be inserted through the central hole from the first face of the base portion without extending beyond the second face and to at least temporarily secure the cap portion to the base portion by engaging the barbs on a shoulder within the base member;

wherein the cap portion comprises a non-circular protrusion at a base of the post, and the first face of the base portion comprises a non-circular recess adapted to receive the protrusion to restrain the base portion and cap portion from rotation relative to one another, such that an orientation of the cap portion is maintained relative to the base portion;

wherein said cap portion is adapted to enclose the open top of each of the pair of channels such that a lanyard cord can be slidably retained in the channels.

5. The lanyard slider of claim 4, further comprising a lanyard cord forming a closed loop and captured between the cap portion and the base portion such that the cord is slidable through the assembled slider.

6. The lanyard of claim 5, wherein the cap portion comprises an image on the upper surface of the cap portion, whereby the inter-engaging non-circular projection and non-circular recess maintain the orientation of the image relative to the cord.

* * * * *